US011713565B2

(12) United States Patent
Song et al.

(10) Patent No.: US 11,713,565 B2
(45) Date of Patent: Aug. 1, 2023

(54) BIDET BODY WITH FLAT BOTTOM SURFACE

(71) Applicant: COWAY CO., LTD., Gongju-si (KR)

(72) Inventors: Minsu Song, Seoul (KR); Hyun Kang Lee, Seoul (KR); Youngpyo Kim, Seoul (KR); Dong Ik Nam, Seoul (KR); Min Hwan Kim, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 20 days.

(21) Appl. No.: 17/438,749

(22) PCT Filed: Dec. 16, 2019

(86) PCT No.: PCT/KR2019/017760

§ 371 (c)(1),
(2) Date: Sep. 13, 2021

(87) PCT Pub. No.: WO2020/189881

PCT Pub. Date: Sep. 24, 2020

(65) Prior Publication Data

US 2022/0154441 A1 May 19, 2022

(30) Foreign Application Priority Data

Mar. 15, 2019 (KR) ..... 10-2019-0030154

(51) Int. Cl.
*E03D 9/08* (2006.01)
*A47K 10/48* (2006.01)

(52) U.S. Cl.
CPC ..... *E03D 9/08* (2013.01); *A47K 10/48* (2013.01)

(58) Field of Classification Search
CPC ..... E03D 9/00
USPC ..... 4/420.4–5
See application file for complete search history.

(56) References Cited

FOREIGN PATENT DOCUMENTS

| | | | | | |
|---|---|---|---|---|---|
| CN | 112203567 | A | * | 1/2021 | ..... A47K 10/48 |
| JP | 2008-121305 | A | | 5/2008 | |
| KR | 20-2010-0004169 | U | | 4/2010 | |
| KR | 10-2010-0085591 | A | | 7/2010 | |
| KR | 20-2011-0011505 | U | | 12/2011 | |
| KR | 10-1303449 | B1 | | 9/2013 | |
| KR | 10-1696214 | B1 | | 1/2017 | |
| KR | 10-2018-0034192 | A | | 4/2018 | |
| KR | 10-1866983 | B1 | | 6/2018 | |
| KR | 10-2018-0127147 | A | | 11/2018 | |
| WO | WO-2022124980 | A1 | * | 6/2022 | |

OTHER PUBLICATIONS

International Search Report dated Apr. 2, 2020 in PCT/KR2019/017760 filed Dec. 16, 2019, 2 pages.
Korean Office Action dated Apr. 26, 2021 in Korean Application No. 10-2019-0030154 filed Mar. 15, 2019, 7 pages.
Korean Notice of Allowance dated Aug. 10, 2021 in Korean Application No. 10-2019-0030154 filed Mar. 15, 2019, 4 pages.

* cited by examiner

*Primary Examiner* — Lori L Baker
(74) *Attorney, Agent, or Firm* — Oblon, McClelland, Maier & Neustadt, L.L.P.

(57) ABSTRACT

A bidet body that includes at least one of a drying nozzle and a cleaning nozzle moving in one of a forward and downward direction and an upward and backward direction, and a bottom surface of a cover that constitutes an exterior of the bidet body may be flat.

11 Claims, 6 Drawing Sheets

BIDET BODY WITH FLAT BOTTOM SURFACE

BACKGROUND OF THE INVENTION

1. Field of the Invention

The present disclosure relates to a bidet body with a flat bottom surface.

2. Description of the Related Art

A bidet is a device that is installed in a toilet seat and which can automatically perform anus cleaning and female local cleaning by spraying washing water through a bidet nozzle and a cleaning nozzle provided in the bidet device.

The front end of a cover constituting the exterior of a bidet body according to the related art has a structure in which the bottom surface of the cover protrudes due to the nozzle cover or the like.

However, the protruding part is located in the position closest to the receiving portion in a toilet bowl, so that even when contamination is concentrated, there is a disadvantage in that it is difficult to clean due to the protruding part.

In addition, it is difficult to check the bottom surface of the cover with the naked eye, and there is also the inconvenience of cleaning the contaminated part only by separating the entire bidet body from the toilet seat.

The bidet is intended to clean a user's local area or anus by spraying a fluid through the bidet nozzle and the cleaning nozzle, and contamination of a part close to the nozzle may cause discomfort.

Korean Registered Patent No. 10-1303449 (Sep. 5, 2013)
Korean Registered Patent No. 10-1866983 (Jun. 14, 2018)
Korean Registered Patent No. 10-1696214 (Jan. 13, 2017)

SUMMARY OF THE INVENTION

The present disclosure provides a bidet body with a flat bottom surface, and more particularly a bidet body that has a flat bottom surface and thus may be easily cleaned and that separates only some parts including a nozzle cover which is detachable from the bottom surface, thereby allowing easy cleaning.

According to an aspect of the present disclosure, there is provided a bidet body in which at least one of a drying nozzle and a cleaning nozzle moving in one of a forward and downward direction and an upward and backward direction is installed and a bottom surface (111) of a cover (110) constituting an exterior of the bidet body is flat.

A nozzle cover (120) may be installed on the bottom surface (111) of the cover (110), and the nozzle cover (120) may include: a first nozzle cover (121) connected to the bottom surface (111); and a second nozzle cover (122) having a rear end connected to the first nozzle cover (121).

A front end (122*a*) and both side ends (122*b*) of the second nozzle cover (122) may be free from the first nozzle cover (121).

The second nozzle cover (122) may be formed at a position where a movement path of the drying nozzle and the cleaning nozzle and the bottom surface (111) of the cover (110) overlap.

The first nozzle cover (121) and the second nozzle cover (122) may be connected to each other by a first elastic member (124).

The nozzle cover (120) may be separably installed on the bottom surface (111) of the cover (110).

The bidet body may further include: a first accommodating portion (132) to which a first cleaning flow path (131) is connected and which extends downward; a second accommodating portion (133) connected to a lower side of the first accommodating portion (132) and having a space larger than that of the first accommodating portion (132); and a cover cleaning unit (130) including a cover cleaning nozzle (134) installed inside the first accommodating portion (132) and the second accommodating portion (133).

The cover cleaning unit (130) may include: a sealing member (135), which is installed in the first accommodating portion (132) and through which a second cleaning flow path (135*a*) communicating with the first cleaning flow path (131) is formed; and a moving member (136), which is installed in the second accommodating portion (133) and in which a reservoir (136*a*) communicating with the second cleaning flow path (135*a*) is formed.

An outer diameter of the sealing member (135) may be the same as an inner diameter of the first accommodating portion (132), and an outer diameter of the moving member (136) may be the same as an inner diameter of the second accommodating portion (133).

The bidet body may further include a second elastic member (137) connecting the sealing member (135) and the moving member (136) to each other, wherein, when a certain amount or more of fluid is stored in the reservoir (136*a*), the moving member (136) is spaced apart from the sealing member (135).

An outlet (136*b*) of the reservoir (136*a*) may be formed on one side surface facing the nozzle cover (120) of the moving member (136).

BRIEF DESCRIPTION OF THE DRAWINGS

The above and other features and advantages of the present invention will become more apparent by describing in detail exemplary embodiments thereof with reference to the attached drawings in which:

FIGS. 5A and 5B are oblique views of the bidet body of FIG. 1 from below, wherein FIG. 5A shows a state in which a moving member is accommodated in the bidet body, and FIG. 5B shows a state in which the moving member protrudes from the bidet body;

DETAILED DESCRIPTION OF THE INVENTION

Hereinafter, the present disclosure will be described in detail with reference to the accompanying drawings.

In addition, hereinafter, assuming that a user is seated in a toilet seat 10 in FIG. 1, it will be described that an upper part of the user is the upper side, a lower part of the user is the lower side, the user's viewing direction is the front, the user's back direction is the rear, a part where the user's left hand is located is the left side, and a part where the user's right hand is located is the right side.

1. Description of Bidet Device

A bidet device according to an embodiment of the present disclosure will be described in detail with reference to FIG. 1.

Figure 1:
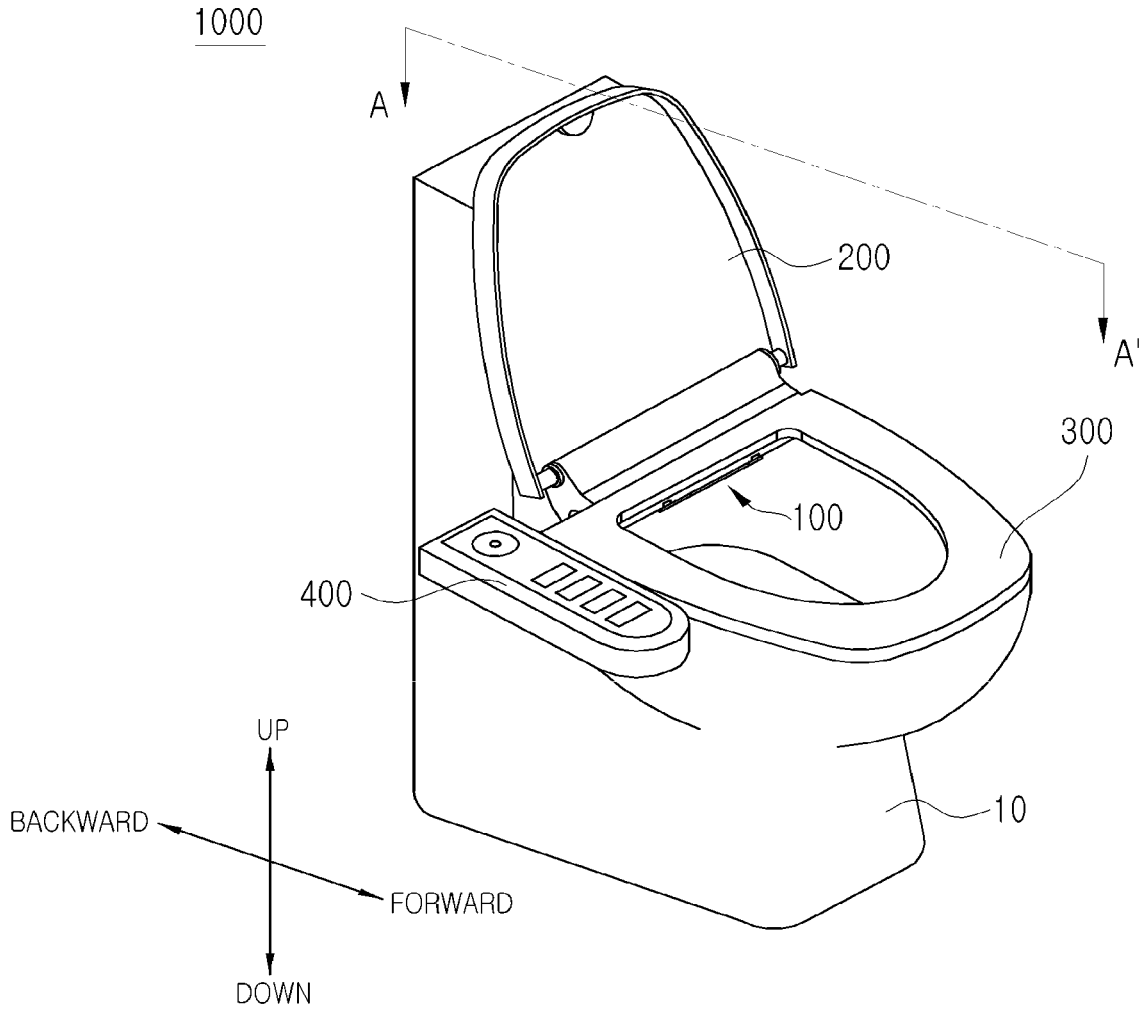
FIG. 1 is a view illustrating a toilet seat in which a bidet device according to an embodiment of the present disclosure is installed.

FIG. 1 is a schematic perspective view illustrating a toilet seat in which a bidet device according to an embodiment of the present disclosure is installed.

Referring to FIG. 1, the bidet device includes a bidet body 100 installed on a toilet seat 10, a seat 300 rotatably mounted on the upper side of the toilet seat 10, a cover 200 rotatably mounted on the seat 300, and an operation unit 400 mounted on the side of the bidet body 100.

The operation unit 400 is provided with buttons for performing water pressure, water temperature, positions of a bidet nozzle and a cleaning nozzle, a sterilization function, a drying function, and the like. When a command is input to each button in a form that the user presses, a function corresponding to the button is performed.

2. Description of Bidet Body

The bidet body 100 according to an embodiment of the present disclosure will be described in detail with reference to FIGS. 2 through 7.

The bidet body 100 may include a cleaning nozzle for cleaning the user's anus, a bidet nozzle for cleaning the user's local area, and a drying nozzle for drying the user's anus or local area, and the bidet body 100 may further include a nozzle cleaning module for cleaning the cleaning nozzle and the bidet nozzle, and a bowl sterilization module for sterilizing the bowl of the toilet seat 10. However, embodiments are not limited thereto, and components necessary for a bidet function may be installed inside the bidet body 100. Detailed description thereof will be omitted.

Figure 2A:
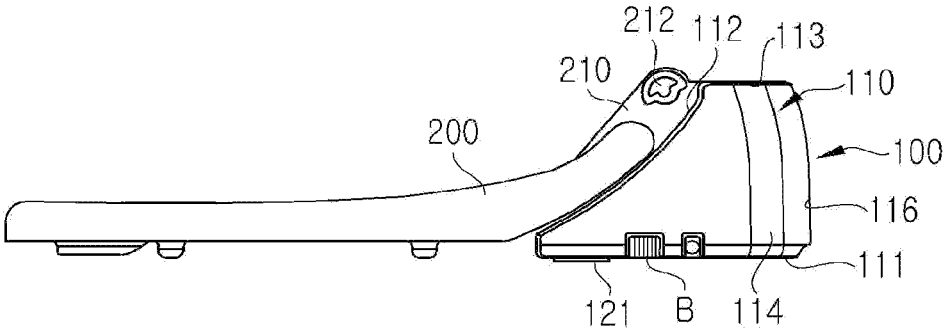
FIGS. 2A and 2B are a side view and a front perspective view, respectively, showing a state in which a nozzle N is accommodated in a bidet body in the bidet device of FIG. 1.
Figure 2B:
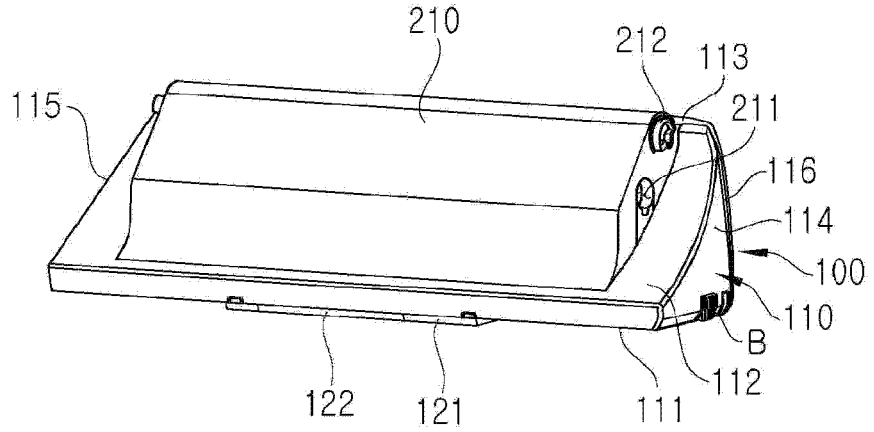

The bidet body 100 may include a cover 110 constituting the exterior thereof. Referring to FIG. 2, the cover 110 may include a bottom surface 111 extending forward, an inclined surface 112 extending in the front and rear directions, a top surface 113 extending forward to face the bottom surface 111, both side surfaces 114 and 115 and a rear surface 116 connecting the bottom surface 111, the inclined surface 112, and the top surface 113.

The bottom surface 111 is a portion in direct contact with the toilet seat 10, and may be formed to be flat all over.

A support portion 210, on which the cover 200 is installed, is installed on the inclined surface 112, and the cover 200 may be coupled and separated through installation holes 211 and coupling protrusions 212 formed on both sides of the support portion 210.

The cover 110 of the bidet body 100 according to the embodiment of the present disclosure may have the bottom surface 111 formed to be flat. A cleaning nozzle for cleaning the user's anus, a bidet nozzle for cleaning the user's local area, and a drying nozzle for drying may be installed in the bidet body 100. Here, a nozzle N may move in a forward and downward direction for cleaning and drying of the user's anus or local area (FIG. 3), and after cleaning or drying is completed, the nozzle N may move in a backward and upward direction and may be stored in the bidet body 100 again (FIG. 2).

In the bidet body 100 according to the embodiment of the present disclosure, the cleaning nozzle and the bidet nozzle may be installed at an angle of 45 degrees to 55 degrees with respect to the bottom surface 111 of the cover 110, preferably at an angle of 50 degrees. As the installation angle of the cleaning nozzle and the bidet nozzle is increased compared to a bidet device according to the related art, the bidet body may be miniaturized.

In addition, an injection angle of a fluid ejected from the cleaning nozzle according to the embodiment of the present disclosure may be 85 degrees to 105 degrees forward with respect to the longitudinal direction of the cleaning nozzle, preferably 95 degrees.

In addition, in the bidet nozzle according to the embodiment of the present disclosure, a nozzle tip mounted on the front end of the bidet nozzle may be installed to be inclined at an angle of 0 degrees to 10 degrees with respect to the longitudinal direction of the bidet nozzle, preferably at an angle of 5 degrees.

In addition, the cleaning nozzle according to the embodiment of the present disclosure may have a length of 80 mm to 120 mm, preferably 100 mm.

In addition, the bidet nozzle according to the embodiment of the present disclosure may have a length of 90 mm to 130 mm, preferably 110 mm.

On the bottom surface 111 of the cover 110 according to the embodiment of the present disclosure, a nozzle cover 120 may be installed at a position where a movement path of the nozzle N and the bottom surface 111 of the cover 110 overlap.

Figure 3A:
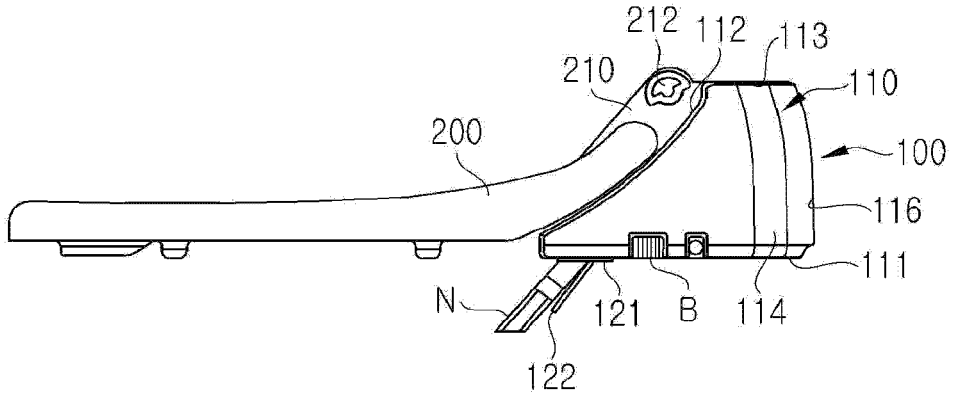
FIGS. 3A and 3B are a side view and a front perspective view, respectively, showing a state in which the nozzle N protrudes from the bidet body in the bidet device of FIG. 1.
Figure 3B:
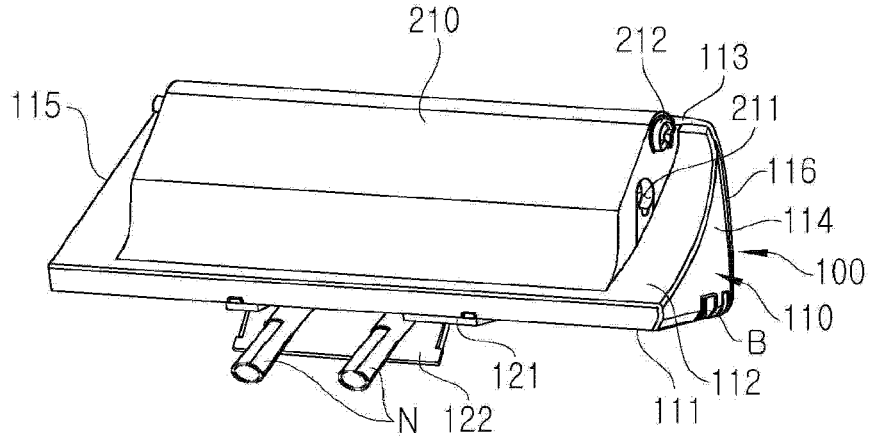
Figure 4A:
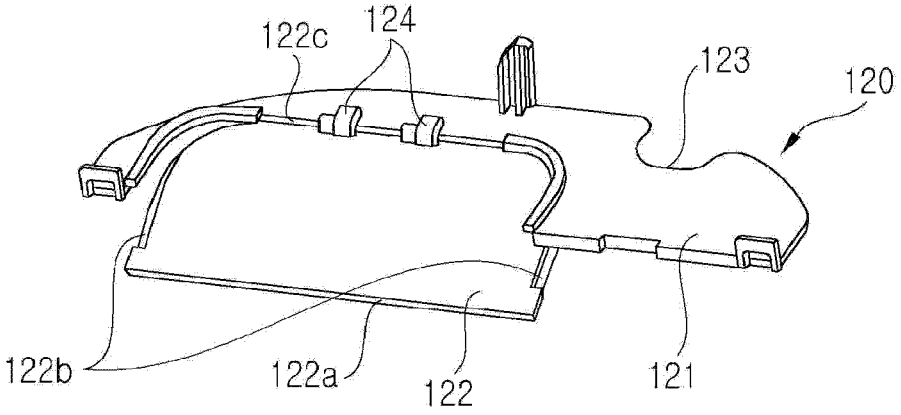
FIGS. 4A and 4B are views for describing a nozzle cover installed in the bidet body of FIG. 1.
Figure 4B:
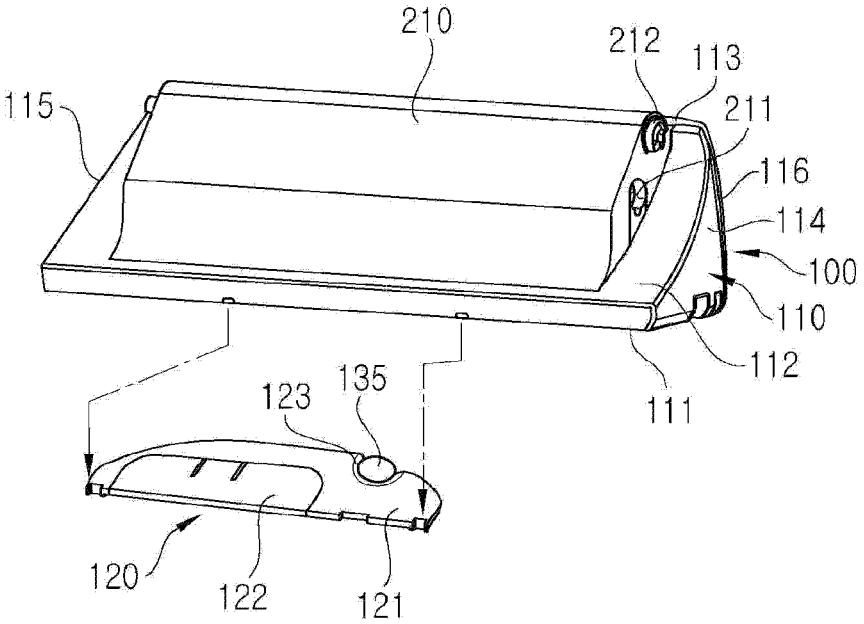
Figure 5A:
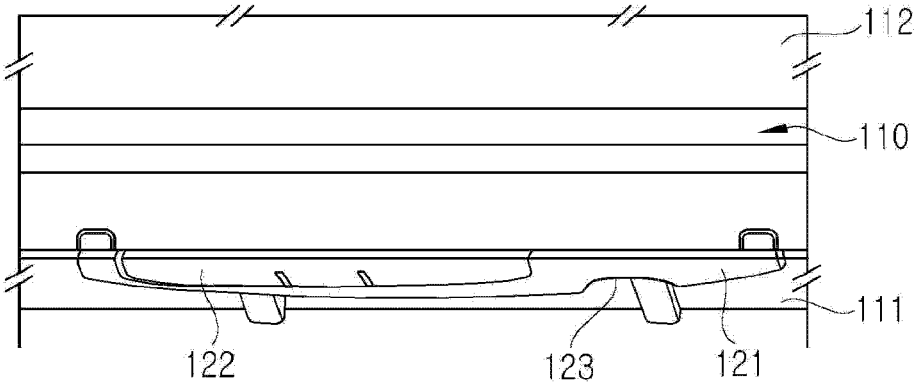
Figure 5B:
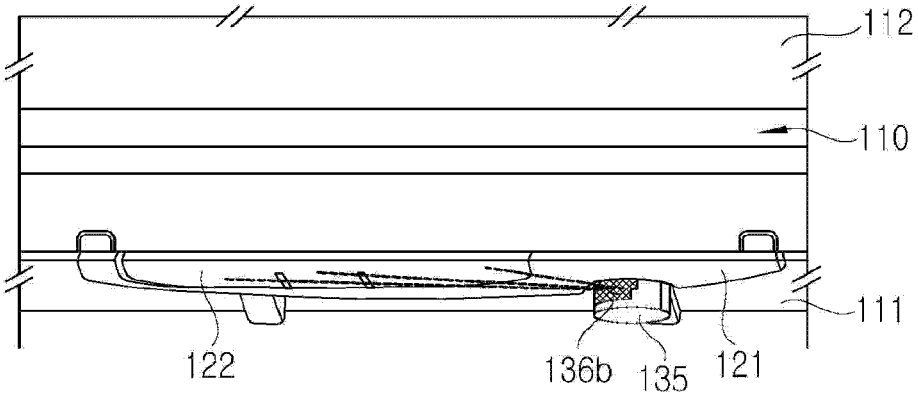

Referring to FIGS. 3 and 4, the nozzle cover 120 may include a first nozzle cover 121 and a second nozzle cover 122.

The first nozzle cover 121 is a portion connected to the bottom surface 111, and even if the nozzle N moves in a forward and downward direction, the installed state of the first nozzle cover 121 may be maintained without movement. That is, the first nozzle cover 121 may serve as a support for the second nozzle cover 122 to be described later. As an example, the first nozzle cover 121 may be hingedly coupled to the bottom surface 111, but embodiments are not limited thereto, and it should be understood that various coupling methods may be applied.

The second nozzle cover 122 has a rear end 122*c* connected to the first nozzle cover 121, and when the nozzle N moves in the forward and downward direction, the second nozzle cover 122 may rotate around a rotation axis of a connection portion with the first nozzle cover 121. That is, as can be seen in FIGS. 3 and 4, a front end 122*a* and both side ends 122*b* of the second nozzle cover 122 are formed freely from the first nozzle cover 121, and when the nozzle N moves in the forward and downward direction, the front end 122*a* and both side ends 122*b* may be spaced apart from the first nozzle cover 121.

The first nozzle cover 121 and the second nozzle cover 122 may be connected to each other by a first elastic member 124. The first elastic member 124 may be, for example, a spring, and embodiments are not limited thereto, and any configuration may be applied which has an elastic force that may be restored to the original shape even if the shape of the first elastic member 124 is deformed by an external force and when the applied force is released. As the first elastic member 124 has a certain elastic force, the second nozzle cover 122 may be opened by the force of the nozzle N to move in the forward and downward direction, and the closing of the second nozzle cover 122 may be performed by way of the elastic force of the first elastic member 124 as the force applied by the nozzle N is released.

A cover cleaning unit 130 for cleaning the nozzle cover 120 may be further formed on the bottom surface 111 of the cover 110.

The cover cleaning unit 130 may be formed at any position on the bottom surface 111, but may be preferably formed at a position close to the nozzle cover 120 for cleaning the nozzle cover 120, and more preferably, as shown in FIG. 4, the cover cleaning unit 130 may be formed at a position in contact with the first nozzle cover 121 and at a position of a cleaning hole 123 of the first nozzle cover 121.

Figure 6:
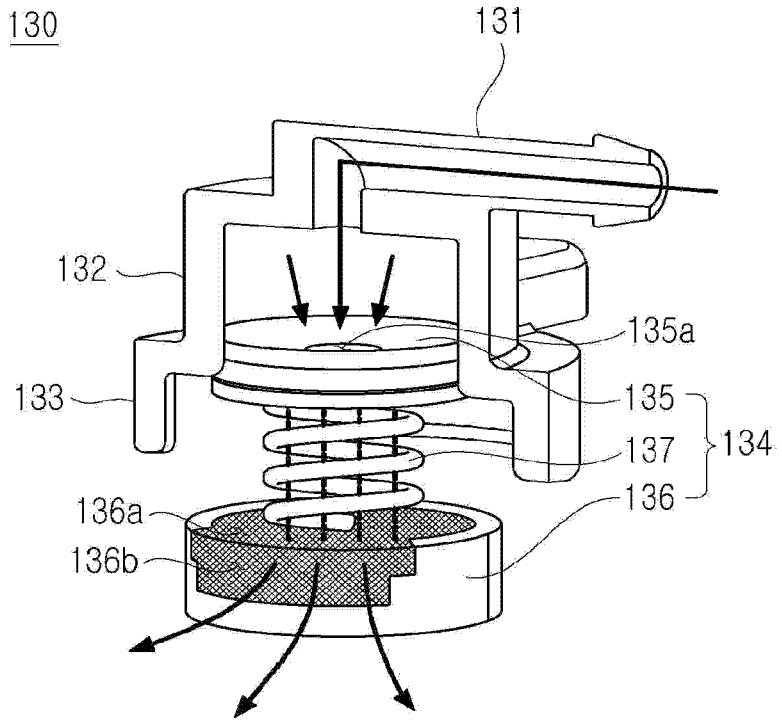
FIG. 6 is a cross-sectional view illustrating a nozzle cleaning unit installed in the bidet body of FIG. 1.

Referring to FIG. 6, the cover cleaning unit 130 may include a first accommodating portion 132, a second accommodating portion 133, and a cover cleaning nozzle 134.

A first cleaning flow path 131 may be connected to the upper side of the first accommodating portion 132, and the first accommodating portion 132 may have a certain space therein, and may extend downward.

The second accommodating portion 133 may be connected to the lower side of the first accommodating portion 132 and has a certain space larger than the space of the first accommodating portion 132 therein.

The cover cleaning nozzle 134 is installed in the first accommodating portion 132 and the second accommodating portion 133 and ejects the fluid supplied from the first cleaning flow path 131 toward the nozzle cover 120. Referring to FIG. 6, the cover cleaning nozzle 134 may include a sealing member 135, a moving member 136, and a second elastic member 137.

The sealing member 135 may be installed in the space inside the first accommodating portion 132, and a second cleaning flow path 135*a* may be formed through the center of the sealing member 135. Here, the outer diameter of the sealing member 135 may be the same as the inner diameter of the first accommodating portion 132. Thus, the fluid supplied from the first cleaning flow path 131 may be transferred to a reservoir 136*a* of the moving member 136 only through the second cleaning flow path 135*a*, which will be described later. In addition, a separate sealing member may be further installed outside the sealing member 135 to prevent the fluid from leaking along the outside of the sealing member 135.

The moving member 136 is installed in the space inside the second accommodating portion 133 under the sealing member 135, and the reservoir 136*a* capable of storing a certain volume of fluid may be formed in the moving member 136. Here, the outer diameter of the moving member 136 may be the same as the inner diameter of the second accommodating portion 133, so that the fluid supplied from the second cleaning flow path 135*a* may be ejected only through an outlet 136*b*. The shape of the reservoir 136*a* is not limited as long as the reservoir 136*a* communicates with the second cleaning flow path 135*a* inside the moving member 136 to store a certain volume of fluid.

A second elastic member 137 may be positioned between the sealing member 135 and the moving member 136. The second elastic member 137 may be, for example, a spring, and embodiments are not limited thereto, and any configuration may be applied which has an elastic force that may be restored to the original shape even if the shape of the second elastic member 137 is deformed by an external force and when the applied force is released. As the second elastic member 137 has a certain elastic force, the cleaning of the nozzle cover 120 may be performed when a certain volume or more of fluid is stored in the reservoir 136*a* of the moving member 136, the moving member 136 is spaced apart from the sealing member 135 so that the fluid may be ejected through the outlet 136*b*, and when the supply of the fluid from the first cleaning flow path 131 is stopped and a volume less than a certain volume of fluid is stored in the reservoir 136*a*, due to the elastic force of the second elastic member 137, the moving member 136 may be moved to contact the sealing member 135 again to be accommodated in the cover 110.

The outlet 136*b* communicating with the reservoir 136*a* may be formed on one side surface of the moving member 136 facing the nozzle cover 120. Accordingly, the fluid ejected through the outlet 136*b* may be directed toward the nozzle cover 120.

The nozzle cover 120 according to the embodiment of the present disclosure may be separated from the bidet body 100. Thus, the nozzle cover 120 may be separated and cleaned separately.

Figure 7A:
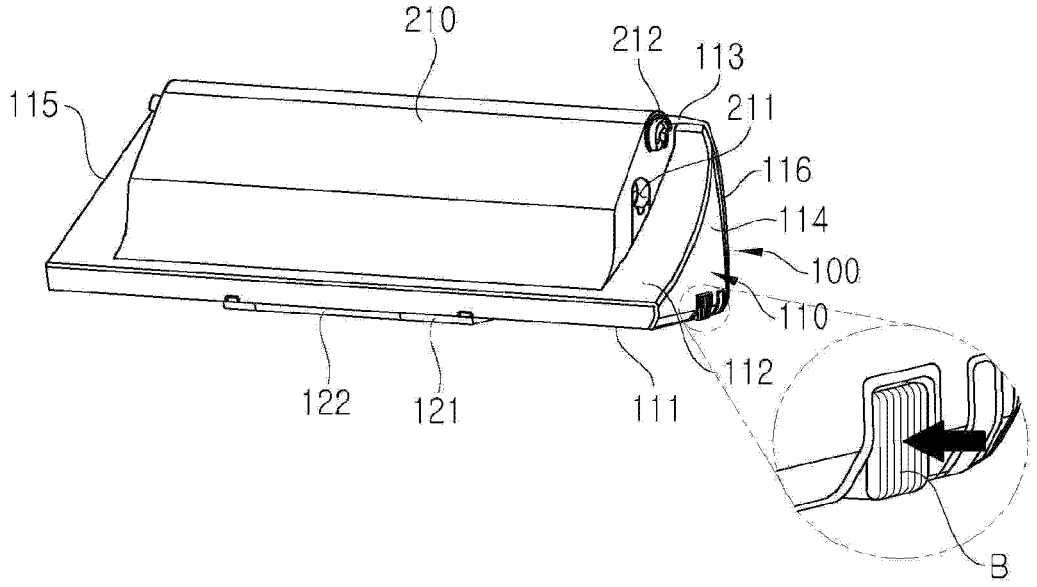
FIGS. 7A and 7B are views for describing a state in which the nozzle cover of FIG. 4 is separated from the bidet body.
Figure 7B:
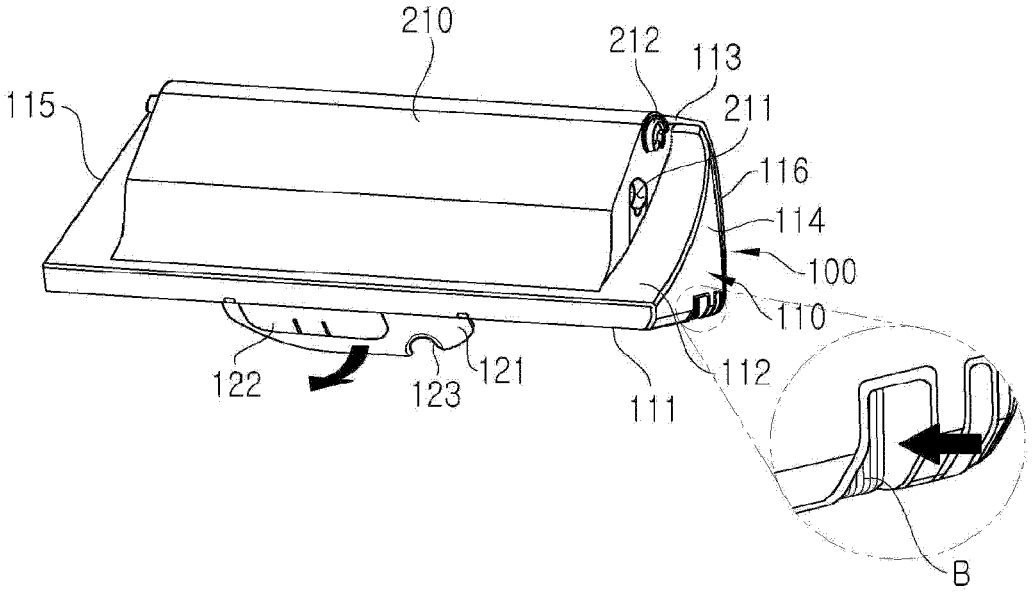

Referring to FIG. 7, a coupling release button B may be provided on one side of the bidet body 100, and when the coupling release button B is pressed, the rear end of the first nozzle cover 121 may be separated from the bidet body 100. Because the front end of the first nozzle cover 121 is hingedly coupled to the bidet body 100, the nozzle cover 120 may be separated from the bidet body 100 by releasing the hinge coupling.

3. Description of Operating Process

Hereinafter, an operating process of the bidet device according to an embodiment of the present disclosure will be described in detail.

A user wishing to use the toilet is seated on the seat 300 of the bidet device. If the cover 200 covers the seat 300, the user is seated on the seat 300 after lifting the cover 200.

After the user sits on the seat 300 and uses the toilet, a certain command is input to a button provided on the operation unit 400, so that a cleaning process of the anus or the local area and a drying process of the cleaned area using the nozzle N will be performed. At this time, the nozzle N installed in the bidet body 100 moves in a forward and backward direction while lifting the second nozzle cover 122, and the fluid is sprayed through a water outlet hole formed in the nozzle N to perform the cleaning process.

Next, when the user inputs a certain command to the button provided on the operation unit 400 to end the cleaning process, the nozzle N moves in an upward and backward direction, and due to the first elastic member 124 connecting the first nozzle cover 121 and the second nozzle cover 122, the second nozzle cover 122 is returned to its original position.

Next, a drying process using a drying nozzle N may be performed according to the user's selection. When the user leaves the seat 300, the fluid is supplied to the first cleaning flow path 131. The supplied fluid is transferred to the reservoir 136*a* of the moving member 136 through the second cleaning flow path 135*a* of the sealing member 135, and when a certain volume or more of fluid is stored in the reservoir 136*a*, the length of the second elastic member 137 is increased so that the moving member 136 is spaced apart from the sealing member 135 and protrudes from the bottom surface 111. Thus, the fluid may be ejected toward the nozzle cover 120 through the outlet 136*b*, and foreign substances of the nozzle cover 120 may be cleaned.

When the fluid supply to the first cleaning flow path 131 is stopped, the shape of the moving member 136 is restored due to the elastic force of the second elastic member 137. Thus, the moving member 136 moves upward to contact the sealing member 135 again.

According to the present disclosure, a bottom surface of a bidet body is provided to be flat, so that a part that is difficult to see with the naked eye can be cleaned conveniently.

In addition, because a nozzle cover can be separated from the bidet body in a portion where contamination is concentrated, the nozzle cover can be cleaned conveniently.

In addition, cleaning of the nozzle cover can be performed automatically using a cover cleaning unit, so that it is easy to maintain cleanliness.

Further, as the lengths of a bidet nozzle and a cleaning nozzle are decreased compared to a bidet device according to the related art, the bidet body can be miniaturized.

While the present invention has been particularly shown and described with reference to exemplary embodiments thereof, it will be understood by those of ordinary skill in the art that various changes in form and details may be made therein without departing from the spirit and scope of the present invention as defined by the following claims.

DESCRIPTION OF REFERENCE NUMERALS

B: coupling release button
N: nozzle
10: toilet seat
100: bidet body
110: cover
111: bottom surface
112: inclined surface
113: top surface
114, 115: side surfaces
116: rear surface
120: nozzle cover
121: first nozzle cover
122: second nozzle cover
123: cleaning hole
124: first elastic member
130: cover cleaning unit
131: first cleaning flow path
132: first accommodating portion
133: second accommodating portion
134: cover cleaning nozzle
135: sealing member
135*a*: second cleaning flow path
136: moving member
136*a*: reservoir
136*b*: outlet
137: second elastic member
200: cover
210: support portion
211: installation holes
212: coupling protrusions
300: seat
400: operation unit

What is claimed is:

1. A bidet body in which at least one of a drying nozzle and a cleaning nozzle moving in one of a front-downward direction and rear-upward direction is installed, wherein the bidet body comprises:

a cover having a flat bottom surface and constituting an exterior of the bidet body;

a nozzle cover installed on the bottom surface of the cover and formed at a position where a movement path of the drying nozzle and the cleaning nozzle overlaps with the bottom surface of the cover; and a cover cleaning unit configured to spray cleaning water toward the nozzle cover, wherein the nozzle cover rotates downwardly as the drying nozzle and the cleaning nozzle move front-downward.

2. The bidet body of claim 1, wherein the nozzle cover comprises:

a first nozzle cover connected to the bottom surface; and a second nozzle cover having a rear end connected to the first nozzle cover.

3. The bidet body of claim 2, wherein a front end and both side ends of the second nozzle cover are free from the first nozzle cover.

4. The bidet body of claim 3, wherein the second nozzle cover is formed at a position where a movement path of the drying nozzle and the cleaning nozzle and the bottom surface of the cover overlap.

5. The bidet body of claim 3, wherein the first nozzle cover and the second nozzle cover are connected to each other by a first elastic member.

6. The bidet body of claim 2, wherein the nozzle cover is separably installed on the bottom surface of the cover.

7. The bidet body of claim 2, wherein the cover cleaning unit comprises:

a first accommodating portion to which a first cleaning flow path is connected and which extends downward;

a second accommodating portion connected to a lower side of the first accommodating portion and having a space larger than that of the first accommodating portion; and a cover cleaning unit including a cover cleaning nozzle installed inside the first accommodating portion and the second accommodating portion.

8. The bidet body of claim 7, wherein the cover cleaning unit comprises:

a sealing member, which is installed in the first accommodating portion and through which a second cleaning flow path communicating with the first cleaning flow path is formed; and a moving member, which is installed in the second accommodating portion and in which a reservoir communicating with the second cleaning flow path is formed.

9. The bidet body of claim 8, wherein an outer diameter of the sealing member is the same as an inner diameter of the first accommodating portion, and an outer diameter of the moving member is the same as an inner diameter of the second accommodating portion.

10. The bidet body of claim 8, further comprising a second elastic member connecting the sealing member and the moving member to each other, wherein, when a certain amount or more of fluid is stored in the reservoir, the moving member is spaced apart from the sealing member.

11. The bidet body of claim 10, wherein an outlet of the reservoir is formed on one side surface facing the nozzle cover of the moving member.

* * * * *